United States Patent [19]

McGee

[11] 4,258,857

[45] Mar. 31, 1981

[54] DISPLAY CAP

[75] Inventor: Eugene S. McGee, Tampa, Fla.

[73] Assignee: Grow Group, Inc., New York, N.Y.

[21] Appl. No.: 934,116

[22] Filed: Aug. 16, 1978

[51] Int. Cl.[3] ..... B65D 51/24

[52] U.S. Cl. ..... 220/212; 206/806; 220/306; 222/180; 248/360

[58] Field of Search ..... 248/359, 360, 318; 220/212, 85 P, 306, 352; 206/806; 211/59.1, 82–84; 222/180, 173, 179.5

[56] References Cited

U.S. PATENT DOCUMENTS

| | | | |
|---|---|---|---|
| 2,294,661 | 9/1942 | Hibbard | 248/359 X |
| 2,462,951 | 3/1949 | Doubble | 220/85 P |
| 2,868,417 | 1/1959 | Legman | 222/180 |
| 3,428,220 | 2/1969 | Osrow | 222/180 X |
| 3,613,958 | 10/1971 | Opp | 248/360 X |

*Primary Examiner*—Allan N. Shoap

*Attorney, Agent, or Firm*—Edwin E. Greigg

[57] ABSTRACT

A cap for a spray can or the like which includes a tubular body having an open lower end for snap-fitting engagement with the upper portion of the can, the upper end of the body closed by an end wall underneath which is provided a diametrically extending passage having opposite ends opening into the side wall of the body to accommodate a pin or the like for hanging the can in a display position.

This invention relates to receptacle closures and more particularly to a cap for a spray can or the like.

1 Claim, 4 Drawing Figures

DISPLAY CAP

BACKGROUND OF THE INVENTION

A wide variety of products commercially available today are packaged in relatively small receptacles such as cans for merchandising to customers in distribution outlets such as department stores, drugstores and the like. Such products include hairsprays, insecticides, paint, etc. and often the can is of the aerosol type provided with an actuating valve for easy dispensing of the packaged product by the customer.

The common practice is to provide a removable cap on the can which serves to protect or conceal the valve particularly at the point of sale whereat the can is purchased. Due to the multitude of everyday products packaged in such cans as well as the wide variety of competitive items which are usually available, shelf space to accommodate such cans becomes limited, imposing a major burden on the merchandiser. While many other items marketed by sales outlets have been adapted to be displayed for sale on panels referred to as "pegboards", to conserve space, the configuration of such cans has defied efforts to utilize the pegboard merchandising technique.

OBJECTS AND SUMMARY OF THE INVENTION

Accordingly, a primary object of this invention is to provide a new and novel display can cap which permits the can to be displayed for sale without the utilization of shelf space.

Another object of the invention is to provide a new and novel display cap for a spray can or the like which permits the can to be displayed as purchased for sale on a merchandise holder of the pegboard type.

Still another object of this invention is to provide a new and novel display cap for a spray can or the like which may be easily molded at low cost from plastic material in a one-piece construction.

A still further object of this invention is to provide a new and novel display cap for a spray can or the like which is adapted to be used on a wide variety of commercially available cans as purchased without modification and which does not require any change in conventional cap construction to adapt the can for pegboard display.

The objects stated above and other related objects are accomplished by the provision of a display cap which includes a tubular body molded from synthetic resinous material and having a sidewall. The lower end of the body is open for detachably mounting the body on the upper end portion of a spray can or the like and the upper end of the tubular body is closed by a top end wall. The body is also provided with a substantially straight, diametrically extending passage subjacent the top end wall having opposite ends opening into the body side wall for accommodating a pin-like holder on a pegboard to support the can attached to the display cap in a hanging position for display.

The invention will be better understood as well as other objects and advantages thereof will become more apparent from the following detailed description of the invention taken in conjunction with the drawings.

DESCRIPTION OF THE PREFERRED EMBODIMENT

Figure 1:
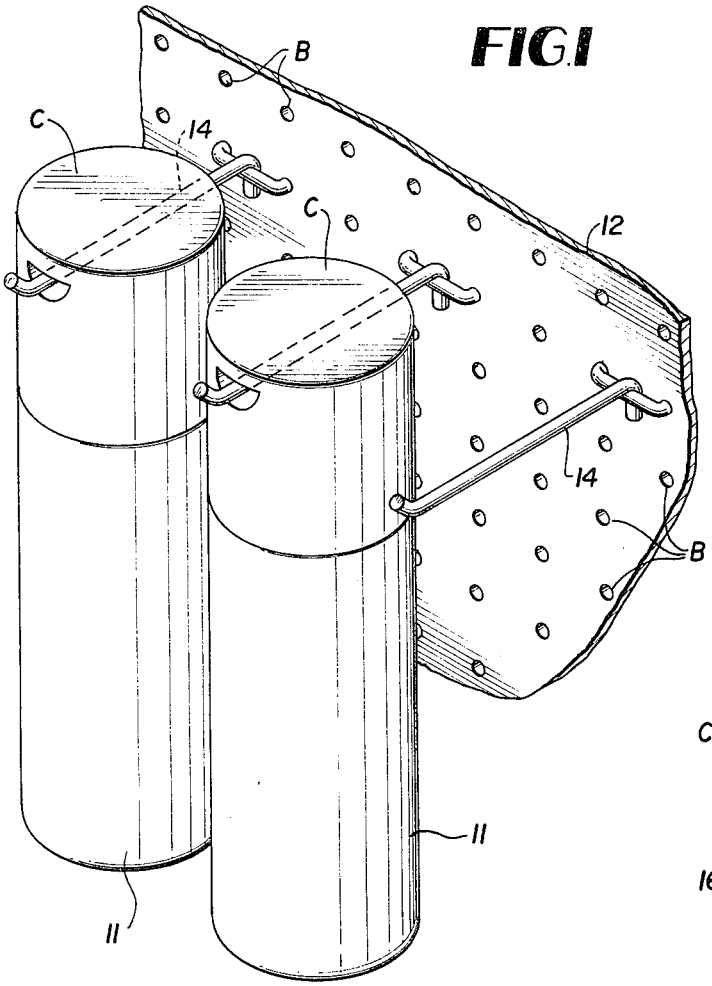
FIG. 1 is a perspective view of a can provided with the display cap of the invention showing the can in a display position.

Referring now to the drawings and to FIG. 1 in particular, there is shown a can 11 of any suitable commercially available type, for packaging products such as insecticide, shaving cream, paint, or the like. Preferably, the can 11 is of the well-known aerosol type to provide a "spray can" provided with an actuating valve (not shown) by means of which the contents of the can 11 may be discharged from the can in form of a spray or the like.

As in the common practice in the manufacture of such spray cans 11 for sale to the consumer, the can 11 is generally provided with a cap of molded plastic construction which is mounted on the upper end portion of the can 11 usually in a snap-fitting manner to thereby enclose and protect the actuating valve disposed on the upper end of the can 11. As is well known, the cap may be removed and may even be discarded so as to provide access to the enclosed actuating valve by the finger of the operator for spraying the contents of the can 11.

Figure 2:
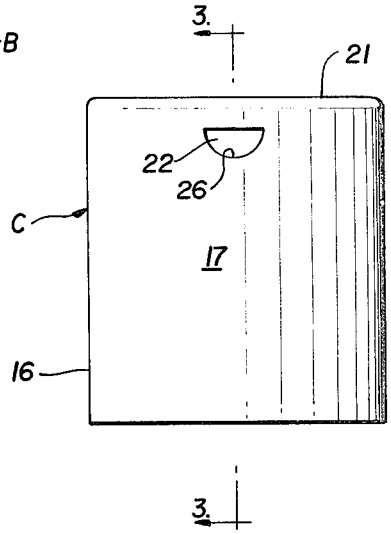
FIG. 2 is a side elevation view of the display cap of the invention.

While present day caps are of cup-shaped configuration and generally molded of suitable plastic material, the display cap of the invention designated generally in FIGS. 1,2 by the letter C, permits the can 11 with its cap attached to be mounted on a popular merchandising device known as a pegboard 12. As is well known, the pegboard 12, as shown in FIG. 1, is a display panel provided with quarter-inch, machine-punched holes 13 usually 2 inches apart into which holders such as pins 14 or the like are inserted. Merchandise which is packaged, for instance, in bags provided with an aperture, are hung on the pegboard 12 by inserting the pin 14 through the bag aperture, thereby hanging the packaged merchandise on the pin 14. Furthermore, it is not uncommon to hand a plurality of such packaged merchandise on a single holder or pin 14.

As specifically illustrative of the invention, the display cap C which is preferably molded of synthetic resinous material in a one-piece construction comprises a tubular body 16 preferably of circular cross-sectional shape, having a side wall 17 and an open lower end 18. As is well known, the open end 18 of the cap C is arranged to accommodate the upper end portion of the can 11 in snug fitting engagement to removably position the cap C on the can 11 in the manner shown in FIG. 1.

Figure 3:
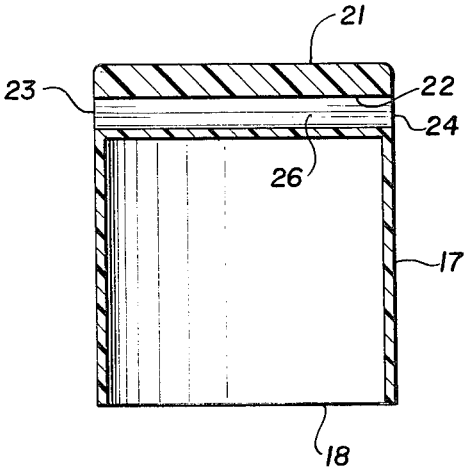
FIG. 3 is a sectional view taken substantially along line 3—3 of FIG. 2 in the direction of the arrows.
Figure 4:
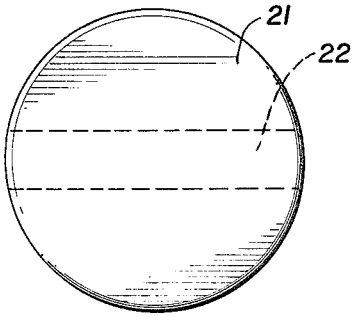
FIG. 4 is a top view of the display cap of FIG. 2.

The upper end of the tubular body 16 on the cap C is closed by an end wall 21 molded integrally with the side wall 17 and of substantially planar configuration. The body 16 is also provided with a substantially straight passage 22 extending perpendicularly to the longitudinal axis of the body 16 as shown best in FIGS. 3, 4. Preferably, the passage 22 extends diametrically on the cap C subjacent the upper end wall 21 with opposite ends 23, 24 opening into the body side wall 16, as shown in FIG. 3. In the illustrated embodiment, the passage 22 is trough-shaped in configuration and is formed by providing a channel 26 semicircular in cross-section, as shown best in FIG. 2, within the interior 20 of the cap C and preferably molded integrally with the side wall 16 and top end wall 21 of the cap C.

With the use of the cap C of the invention, in the installed position on the upper end portion of a can 11 as shown in FIG. 1, the can is mounted for display by inserting a holder such as pin 14 extending from a pegboard 12 into the passage 22 so that the can 11 is suspended or hung on the pin 14 for display in an attractive manner for ready access and removal by the customer. It should be understood, that the snug-fitting engagement between the cap C and the can 11 is such as to present no problem of detachment of the display cap C from the can as is typical of conventional caps utilized on spray cans such as can 11 today.

What is claimed is:

1. A display cap for detachably securing to the upper end portion of a container, said cap comprising a tubular body having a side wall closed at one end by a top wall unitarily formed therewith and opened at the the other end for mounting to the container, said top wall bounded by a closed, planar exterior wall surface and a closed, planar interior wall surface spaced apart by the thickness of material of said top wall, the outer surface of said side wall being in the same plane along any vertical line about its periphery along said outer surface from adjacent said other end to adjacent said exterior wall surface, a continuous, substantially straight passage extending through said thickness of material perpendicular to the longitudinal axis of said body and being below said exterior wall surface and above said interior wall surface, said passage having opposite opened ends through said side wall for accomodating an associated extending support pin for hanging the container with said cap secured thereon in a display position, said passage being surrounded continuously about the whole periphery thereof and along its entire length by said thickness of material.

* * * * *